US005970863A

United States Patent [19]

Dal Ceredo

[11] Patent Number: 5,970,863

[45] Date of Patent: Oct. 26, 1999

[54] APPARATUS FOR STAMPING SKINS

[75] Inventor: Giuliano Dal Ceredo, Montecchio Maggiore, Italy

[73] Assignee: Ger Elettronica S.R.L., Montecchio Maggiore, Italy

[21] Appl. No.: 08/759,126

[22] Filed: Dec. 2, 1996

[51] Int. Cl.[6] ..... B41F 17/00

[52] U.S. Cl. ..... 101/35; 400/82; 400/120.01; 101/44

[58] Field of Search ..... 101/35, 216, 41, 101/42, 43, 44; 250/560; 400/625, 703, 709, 82, 120.01, 120.02, 120.05

[56] References Cited

U.S. PATENT DOCUMENTS

| | | | |
|---|---|---|---|
| 4,259,591 | 3/1981 | Morris et al. | 250/560 |
| 4,969,048 | 11/1990 | Hoshino | 400/625 |
| 5,138,336 | 8/1992 | Goto | 400/120.01 |
| 5,611,629 | 3/1997 | Paranjpe | 400/82 |
| 5,749,662 | 5/1998 | Sbibasaki et al. | 400/82 |

*Primary Examiner*—Christopher A. Bennett
*Attorney, Agent, or Firm*—Hoffman, Wasson & Gitler

[57] ABSTRACT

An apparatus for stamping skins including a plurality of stamping units of thermal transfer type, positioned side by side trasverse to a direction of advancement of the skin. Each stamping unit is provided with at least one skin presence sensor which enables the corresponding stamping unit to operate, and further includes a skin advancement sensing element.

14 Claims, 3 Drawing Sheets

APPARATUS FOR STAMPING SKINS

FIELD OF THE INVENTION

This invention relates to an apparatus for stamping skins.

DESCRIPTION OF THE PRIOR ART

Skin measuring machine are known, ie machines able to measure the surface area of a skin. The general principle on which these known machines is based is to advance the skin along said measuring machine and divide it ideally into narrow longitudinal strips, each of which is "read" by a suitable reader consisting of a light emitter, the light striking the skin to be measured, and a receiver associated with said emitter and able to sense the presence of the skin. The various skin presence signals, suitably processed, are integrated to provide a numerical value related to the area of the skin being measured.

The numerical value is transmitted to a thermal transfer stamping device positioned downstream of the machine, which marks the skin with the measured surface area.

As the skins are measured and stamped mainly for sale purposes, and as it is desirable to stamp the trademark of the producing firm and possibly also the production batch number on various parts of the skin, it has been proposed in various measuring machines to modify the command to the traditional stamper so that it makes repetitive stampings carrying the trademark of the firm and/or the batch number on the skin.

A drawback of this method is that not all the skin is reliably identified in that it is marked along a single longitudinal line and not over its entire surface, as is necessary to satisfy current identification requirements when the skin is cut into pieces.

To overcome this drawback it has been proposed to make the skin pass along a machine provided with an inked roller for discontinuous regions, which is positioned transversely to the direction of advancement of the skin and has a length equal to its width.

This machine has however other drawbacks, and in particular:

- high labour cost due to the use of personnel for inserting (at the entry) and withdrawing (at the exit) the individual skins which, if of large dimensions, can require the simultaneous employment of four persons,
- impossibility of modifying the data to be marked, unless the roller is replaced as required,
- a suitable equipment for allowing the ink to dry before stacking the skins on each other for storing, with consequent increase of costs, encumbrance and loss of time,
- an ever present risk of ink migration between stacked skins (split grain), due to the action of the solvents used in previous treatments,
- if the skins pass automatically from the belt of the measuring machine to the multiple stamping machine, long belts with diverging strands have to be used to enable the skin to return properly taut after stamping. In any event it cannot be ensured that the skin arrives below the roller properly taut, so creating problems of uniform marking.

SUMMARY OF THE INVENTION

An object of the invention is to eliminate these drawbacks by providing an apparatus for stamping the entire skin surface which is of high reliability.

A further object of the invention is to provide an apparatus which can be coupled to a measuring machine.

According to the invention all these drawbacks are eliminated through an apparatus for stamping skins comprising a plurality of stamping units of thermal transfer type, positioned side by side trasverse to a direction of advancement of the skin, and each provided with at least one skin presence sensor which enables a corresponding stamping unit to operate, and further comprising a skin advancement sensing element.

BRIEF DESCRIPTION OF THE DRAWINGS

A preferred embodiment of the present invention is described in detail hereinafter with reference to the accompanying drawings, in which.

DESCRIPTION OF A PREFERRED EMBODIMENT

Figure 1:
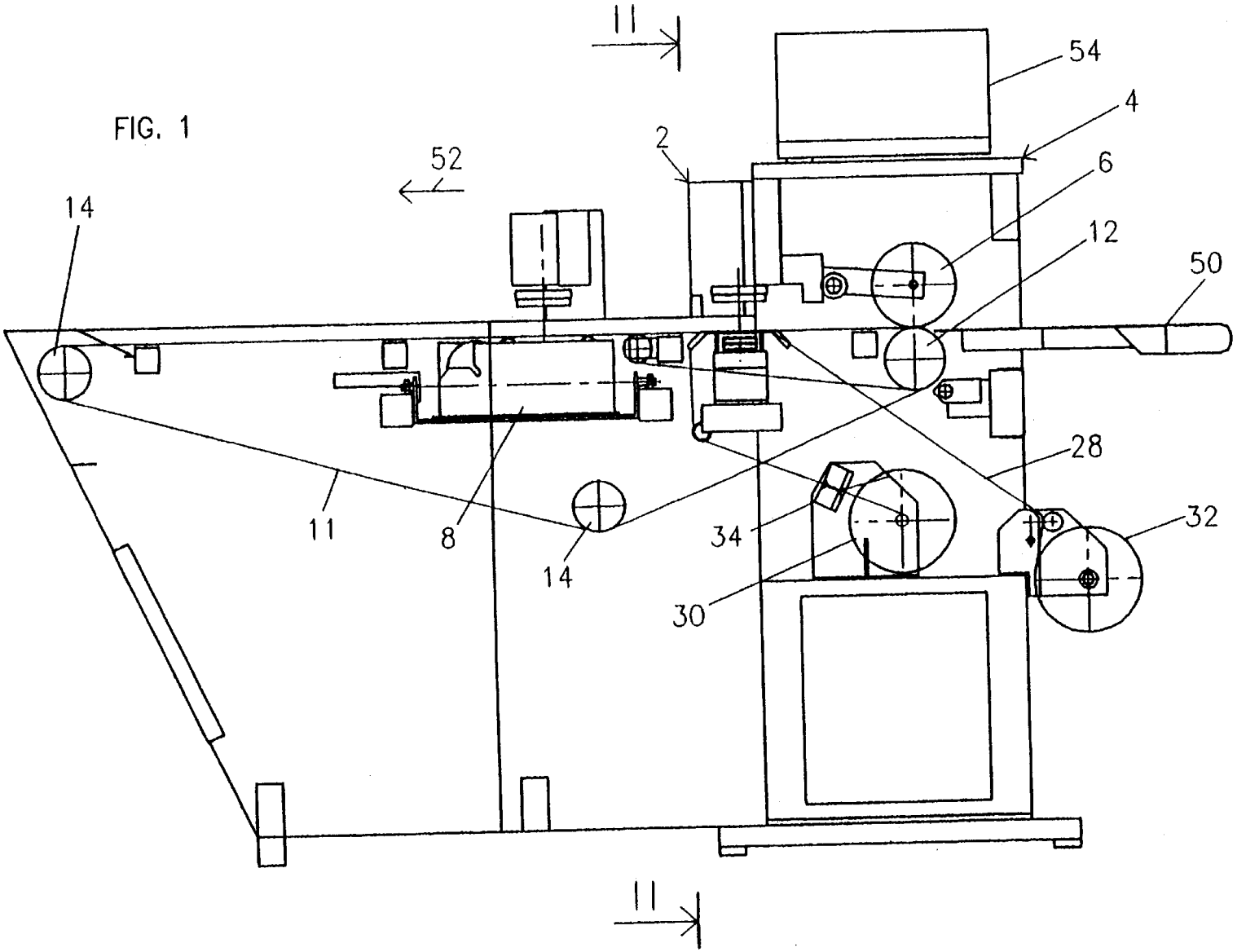
FIG. 1 is a schematic longitudinal section through a multiple stamping apparatus, associated with a skin measuring machine.
Figure 2:
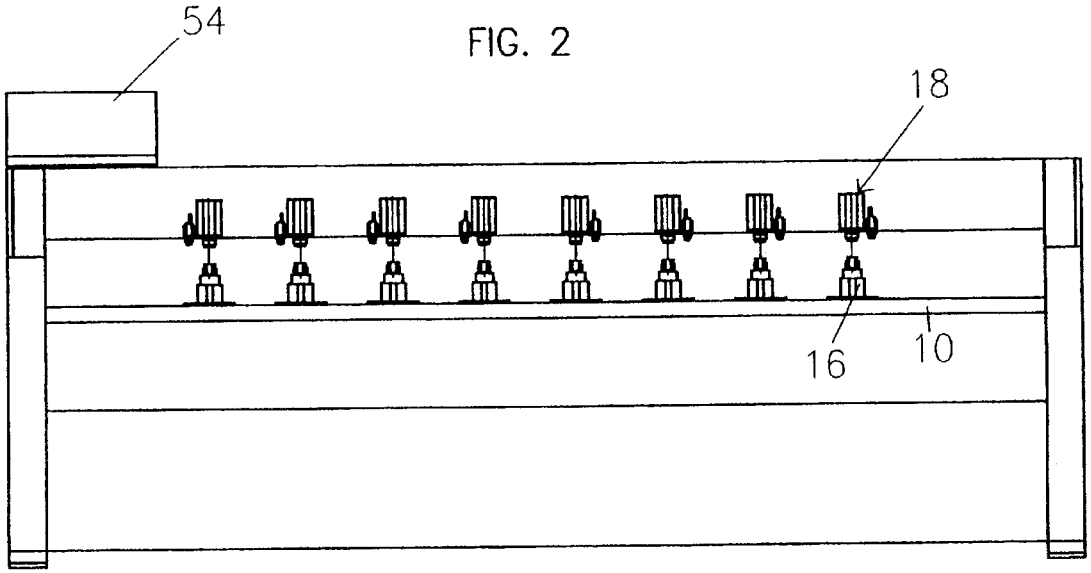
FIG. 2 is a cross-section therethrough on the line II—II of FIG. 1.
Figure 4:
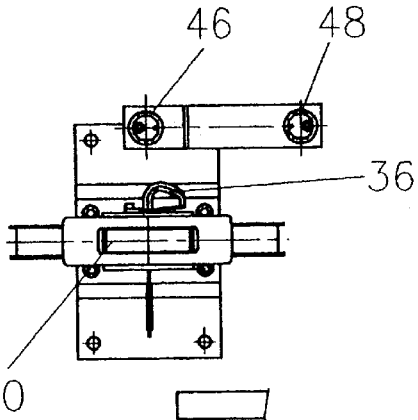
FIG. 4 is a view thereof from above.
Figure 3:
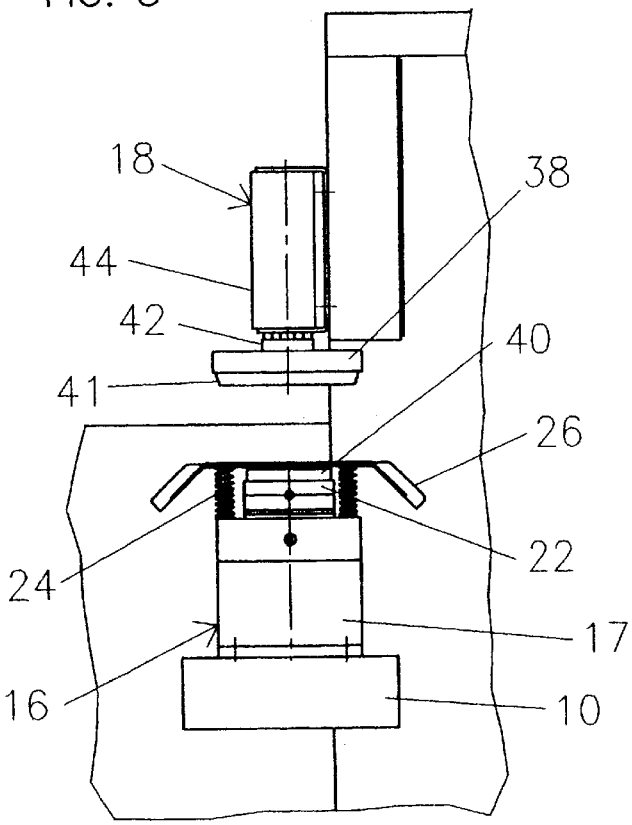
FIG. 3 is an enlarged detail of the stamping unit.

As can be seen from the figures, the multiple stamping apparatus according to the invention is indicated overall by 2 and is mounted on an electronic measuring machine 4, between the measurement rollers 6 and the device 8 for stamping the measured surface area.

The multiple stamping apparatus 2 consists of a bar 10 positioned transversely below the skin advancement surface, consisting of side-by-side rubber belts 11 passing about a drive roller 12 and deviation rollers 14, and supporting a plurality of thermal units 16 which are faced in an overlying position by corresponding pad units 18.

Each termal unit 16, which is electrically powered independently, comprises a base support 17, a heater element 22 provided with a thermal sensor 36, a punch 40 and coil springs 24 which support a guide element 26 for a polyester web 28 supporting a thermal transfer pigment. The thermal web 28 is unwound from a roller 30 and is rewound onto a further roller 32 driven by an electric motor (not shown on the drawings), the operation of which is synchronized with the stamping frequency of the units 16.

Figure 5:
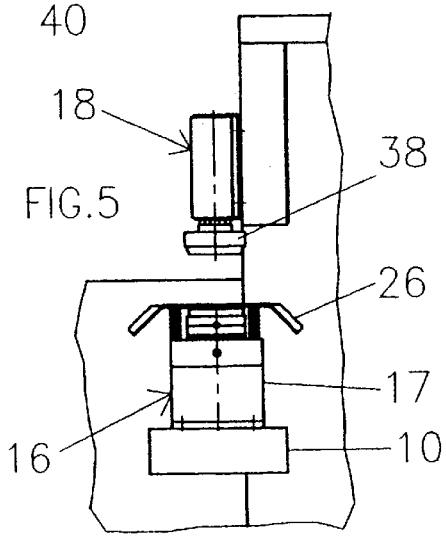
FIG. 5 shows it in a further embodiment without springs.
Figure 6:
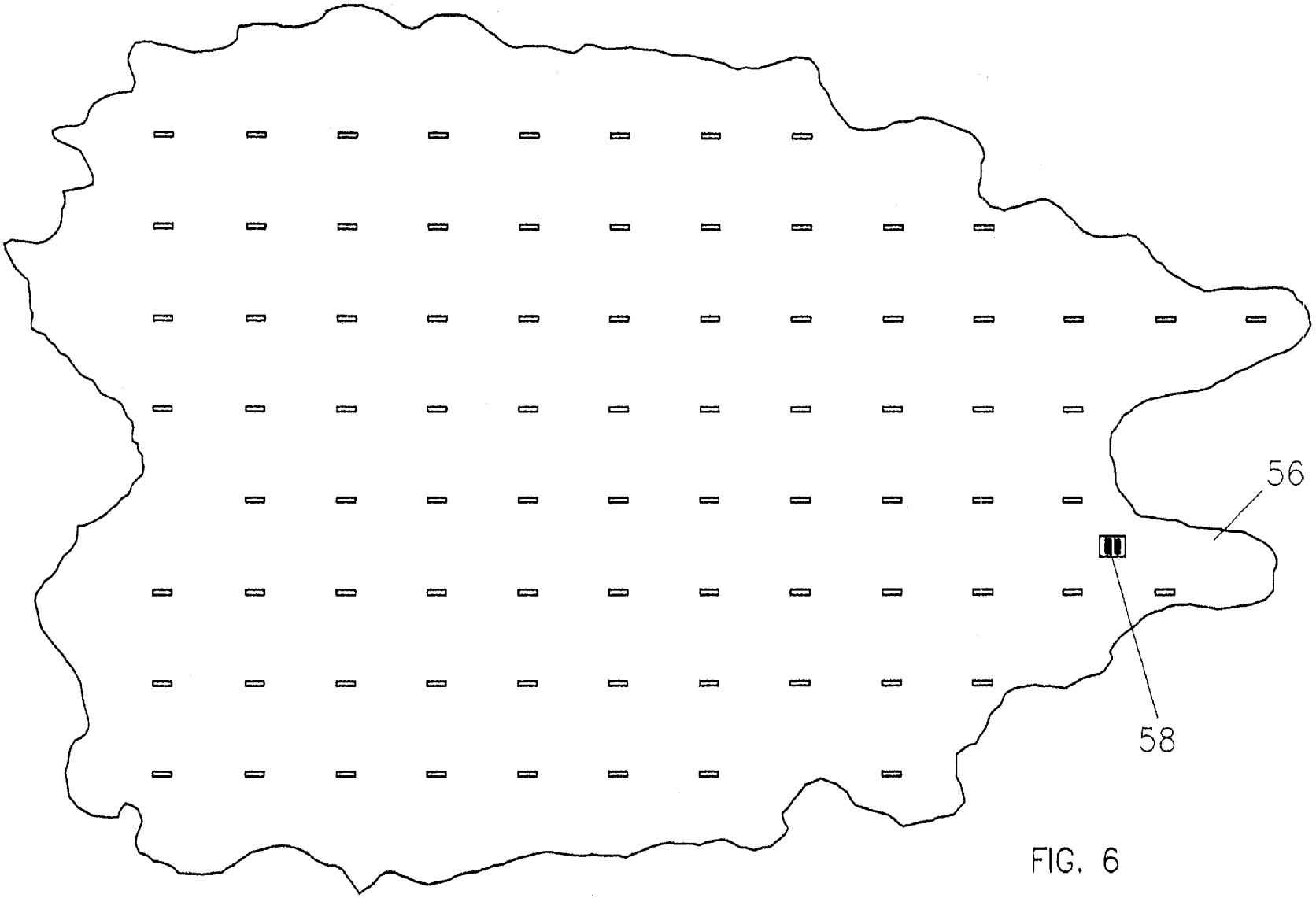
FIG. 6 shows a skin after stamping.

In the embodiment shown in FIG. 5 the guide element 26 is shaped so as not to require the presence of coil springs 24.

The rollers 30 and 32 are positioned below the electronic measuring machine 4 and have a greater diameter than the rollers of the stamping device 8, given the considerable consumption of pigmented web 28 compared with the consumption of the web used by said stamping device.

In correspondence with the unwinding roller 30 there is provided an end-of web sensing element 34 with which there is associated a warning lamp (not shown on the drawings). In the absence of external forces, the springs 24 maintain the guide element 26 raised so that the web 28 is distanced from the punch 40.

Each pad unit 18 consists of a plate 38 supporting a rubber pad 41 rigid with the rod 42 of a pneumatic cylinder 44 of vertical axis. In a position to the side of each pad unit 18 there are provided two photoelectric cells 46 and 48. The arrangement of these photoelectric cells is such that they simultaneously detect the presence of the skin only when this is below the pad 18.

The apparatus of the invention operates as follows.

The skin is fed onto the table 50 of the measuring machine and is made to pass between the conveying roller 12 and the measurement rollers 6. The conveyor belts 11 cause the skin to advance in the direction indicated by the arrow 52. Simultaneously, using traditional photoelectric cell measurement techniques, the encoder present within each measurement roller 6 begins to count the area of the surface of the skin advancing below it.

An electronic control unit 54 connected to each measurement roller 6 then processes the data received, converting them into a value expressing the surface area measurement, which is transferred to the stamping device 8, which prints it on the rear 58 of the skin 56.

Simultaneously, during the advancement of the skin above the bar 10, the photoelectric cells determine the presence or absence of skins passing between the individual stamping units, and in the case of presence they cause the rod 42 to emerge from the pneumatic cylinder 44. As a result of the elongation of the pneumatic system, the pad 41 presses the skin against the underlying web 28 and, overcoming the elastic reaction of the springs 24, against the punch 40 which, because of its temperature, causes microfusion of the pigment and transfers it onto the lower side of the skin.

If however during the skin advancement the photoelectric cells 46,48 do not detect the presence of skin, and this in particular for the end stamping units (contour irregularity), or in general because of the possible presence of holes provided in the skin, the stamping unit corresponding to those photoelectric cells remains inactive.

As for each descent of the rod 42 of the cylinder 44 there corresponds one advancement step of the pigmented web 28, it should be noted that, by virtue of a transparent portion provided in the end part thereof, the sensor 34 indicates, by means of the warning lamp, the need to replace this web and simultaneously deactivates the corresponding stamping unit to enable the operator to replace the empty spool with a new one. This partial deactivation of the stamping system does not cause substantial inconvenience given the large number of stampings effected over the entire skin and the short deactivation time required for this replacement.

With regard to the most outer stamping units, which generally do not operate with the same frequency as the others because of the irregularity of the longitudinal contours of the skin, their sensors if necessary provide for interrupting the circuit powering the heater element 22, so as to prevent its overheating.

From the aforegoing description it is apparent that the apparatus of the invention has numerous advantages, and in particular:

- it enables measurements and stamping to be carried out simultaneously,
- because of its association with the measuring machine, it enables the same labour to be used as that which feeds the skin thereto, with a consequent cost saving,
- it enables chequered stamping to be effected over the entire skin surface with high reliability and without having to wait for the ink to dry as in traditional machines,
- because of its positioning close to the measuring unit, it offers high stamping reliability, in that the skin leaving said measuring unit is still taut because of the effect of the pressure exerted by the rollers,
- it does not involve substantial increase of sizes in the stamping machine as it is interposed between two devices, ie the measurement rollers 6 and the stamping device 8, and hence requires no further space,
- because of the presence of the two photoelectric cells, it offers high stamping reliability both with regard to stamping frequency and with regard to the elimination of wasted stamping,
- it enables either the punch reproducing the firm's logo or a sectional series of punches forming the production batch code to be mounted on the stamping units,
- it enables the winding roller 30 to be positioned close to the unwinding roller 32, and both far from the units 16 with considerable space saving as the strength of the polyester web allows it a long free path,
- because of the position of the rollers 30 and 32 they can be rapidly and easily replaced when the pigmented web 28 is exhausted, this being achievable without interrupting the operating cycle of the measuring machine and in particular without stopping the conveyor belts 11,
- it reduces the replacement frequency of the pigmented web 28 wound about the rollers 30 and 32, by virtue of their diameter when compared with that of the web of the stamping device 8.

In a modified embodiment, not shown on the drawings, the stamping units, instead of being controlled by the photoelectric cells 46,48 are controlled by the actual photoelectric cells associated with the measurement rollers 6. In this case a delay must be provided in the operation of the thermal units 16 and pad units 18, this delay being related to the distance between the measurement rollers 6 and the stamping units.

In a further modified embodiment, not shown on the drawings, the stamping units instead of being operated simultaneously are operated displaced in phase.

I claim:

1. An apparatus for measuring and stamping skins comprising on a frame:

advancement means on which said skins to be treated rest, a measuring unit of a surface of said skins comprising at least one reader device of said skin, at least one advancement sensing element of said skin, and a processing unit for data received from said reader unit, a plurality of impact stamping apparatus of thermal transfer type, positioned side-by-side transverse to a direction of advancement of said skins, each of said plurality of impact stamping apparatus comprising a heater element and a pad suitable to instantaneously press said skin and a pigmented web, facing said skin, against said heater element, each of said multiple stamping apparatus being provided with at least one skin presence sensor which enables said corresponding impact stamping unit to operate, said stamping unit being placed immediately downstream from said reader unit for said skin.

2. An apparatus as claimed in claim 1, wherein said skin advancement sensing element is a skin measurement roller provided in a measuring machine.

3. An apparatus as claimed in claim 1, wherein said heater element is mounted on a base support provided with coil springs which support a guide for said pigmented web.

4. An apparatus as claimed in claim 1, wherein said thermal units are mounted on a bar.

5. An apparatus as claimed in claim 1, wherein said pad is rigid with a rod of a pneumatic cylinder of vertical axis.

6. An apparatus as claimed in claim 1, wherein said web is made to advance along said thermal unit by rollers operated by a motor with rotation synchronized with a stamping frequency.

7. An apparatus as claimed in claim 6, wherein each roller is provided with an end-of-web sensing element.

8. An apparatus as claimed in claim 1, wherein said skin presence sensors comprise photoelectic cells positioned substantially to a side of each stamping unit.

9. An apparatus as claimed in claim 1, wherein said presence sensors comprise photoelectric cells which sense skin presence during skin measurement.

10. An apparatus as claimed in claim 1, wherein said skin measuring machine also comprises a traditional stamping device, positioned downstream of said apparatus.

11. An apparatus as claimed in claim 6, wherein said rollers are of greater diameter than a roller of said stamping units.

12. An apparatus as claimed in claim 6, wherein said rollers are positioned below an advancement surface of a measuring machine.

13. An apparatus as claimed in claim 1, wherein pigmented web is formed of polyester.

14. An apparatus as claimed in claim 10, wherein said rollers are of greater diameter than rollers of said stamping units.

* * * * *